US006248228B1

(12) United States Patent
Gillman et al.

(10) Patent No.: US 6,248,228 B1
(45) Date of Patent: Jun. 19, 2001

(54) METAL ALLOY HALIDE ELECTROPLATING BATHS

(75) Inventors: Hyman D. Gillman, Spring City, PA (US); Brenda Fernandes; Kazimierz Wikiel, both of Cranston, RI (US)

(73) Assignee: Technic, Inc. and Specialty Chemical System, Inc., Cranston, RI (US)

( * ) Notice: Subject to any disclaimer, the term of this patent is extended or adjusted under 35 U.S.C. 154(b) by 0 days.

(21) Appl. No.: 09/272,550

(22) Filed: Mar. 19, 1999

(51) Int. Cl.[7] ..... C25D 3/02

(52) U.S. Cl. ..... 205/239; 205/240; 205/241; 205/242; 205/244; 205/246; 205/254; 205/255; 205/274; 205/281; 205/296; 205/302; 205/311; 106/1.21; 106/1.25

(58) Field of Search ..... 205/239, 240, 205/241, 292, 244, 246, 254, 255, 274, 281, 296, 302, 311; 106/1.4, 1.25

(56) References Cited

U.S. PATENT DOCUMENTS

| | | | | |
|---|---|---|---|---|
| 2,525,942 | * | 10/1950 | Proell | 205/281 |
| 2,910,413 | * | 10/1959 | Strauss et al. | 205/281 |
| 4,013,523 | | 3/1977 | Stevens et al. | 204/43 |
| 4,053,374 | | 10/1977 | Crowther | 204/51 |
| 4,270,990 | | 6/1981 | Fong | 204/55 R |
| 4,459,185 | | 7/1984 | Obata et al. | 204/43 |
| 4,560,446 | | 12/1985 | Nguyen et al. | 204/58.5 |
| 4,612,091 | | 9/1986 | Benaben et al. | 204/51 |
| 4,717,460 | | 1/1988 | Nobel et al. | 204/444 |
| 4,828,657 | | 5/1989 | Fukuoka et al. | 204/44.4 |
| 4,871,429 | | 10/1989 | Nobel et al. | 204/44.4 |
| 5,051,154 | | 9/1991 | Bernards et al. | 204/24 |
| 5,066,367 | | 11/1991 | Nobel et al. | 204/44.4 |
| 5,174,886 | | 12/1992 | King et al. | 205/125 |
| 5,492,615 | | 2/1996 | Houman | 205/238 |
| 5,538,617 | | 7/1996 | Steinbicker et al. | 205/302 |
| 5,562,814 | | 10/1996 | Kirby | 205/238 |
| 5,628,893 | | 5/1997 | Opaskar | 205/300 |
| 5,759,381 | * | 6/1998 | Sakurai et al. | 205/253 |
| 5,897,763 | * | 4/1999 | Elligsen et al. | 205/271 |

FOREIGN PATENT DOCUMENTS

| | | |
|---|---|---|
| 0 455 166 A1 | 6/1991 | (EP) . |
| 0 787 834 A1 | 1/1997 | (EP) . |

OTHER PUBLICATIONS

Meibuhr et al., *Noble Metal Resistors in Microcircuits*, "The Mechanism of the Inhibition of Stannous–Ion Oxidation by Phenolsulfonic Acid", vol. 2, No. 9–10, Sep.–Oct. 1964 pp. 267–273.

Lasia et al., "Double–layer effects in the kinetics of the $CD^2$+/CD (Hg) system in dimethylsulfoxide", *J. Electroanal. Chem.*, 266 (1989), pp. 69–81.

Fawcett et al., "Double layer effects in the kinetics of electroreduction of zinc(II) at mercury in dimethylformamide and dimethylsulfoxide", *J. Electroanal. Chem.*, 279 (1990), pp. 243–256.

Balch et al., "The solvent effect on the electrochemical behavior of $C_{60}$ films in the presence of alkali–metal cations", *Journal of Electroanalytical Chemistry* 427 (1997), pp. 137–146.

Lasia et al., "Mechanism ofo zinc(II) reduction in DMSO on mercury", *J. Electroanal. Chem.*, 288 (1990), pp. 153–164.

* cited by examiner

*Primary Examiner*—Kishor Mayekar
(74) *Attorney, Agent, or Firm*—Ernst V. Linek; Banner & Witcoff, Ltd.

(57) ABSTRACT

The use of alkali metal, alkaline earth metal, ammonium and substituted ammonium salts of alkyl and alkanol sulfonic acids as additives in pure metal and metal alloy halide electroplating baths has a number of unexpected benefits including wider useful current density range and improved appearance. The metals and metal alloys include but are not limited to tin, lead, copper, nickel, zinc, cadmium, tin/zinc, zinc/nickel and tin/nickel.

12 Claims, No Drawings

METAL ALLOY HALIDE ELECTROPLATING BATHS

CROSS-REFERENCE TO RELATED APPLICATIONS

The present invention is related to the following commonly owned applications filed on even date herewith; Metal Alloy Fluoroborate Electroplating Baths, U.S. Ser. No. 09/273,119, now U.S. Pat. No. 6,179,985; Metal Alloy Sulfonate Electroplating Baths, U.S. Ser. No. 09/272,551, now U.S. Pat. No. 6,183,619; and Metal Alloy Sulfate Electroplating Baths, U.S. Ser. No. 09/272,800, pending; all filed Mar. 19, 1999; the disclosures of which are hereby incorporated herein by reference.

BACKGROUND OF THE INVENTION

Electroplating solutions are usually aqueous. Every plating solution contains ingredients to perform at least the first, and usually several, of the following functions: (1) provide a source of ions of the metal(s) to be deposited; (2) form complexes with ions of the depositing metal; (3) provide conductivity; (4) stabilize the solution against hydrolysis or other forms of decomposition; (5) buffer the pH of the solution; (6) regulate the physical form of the deposit; (7) aid in anode corrosion; and (8) modify other properties peculiar to the solution involved.

The present invention improves the plating performance of the solution, particularly by increasing the useful current density over previously accepted norms The current density is the average current in amperes divided by the area through which that current passes, the area is usually nominal area, since the true area for any but extremely smooth electrodes is seldom known. Units used in this regard are amperes per square meter ($A/m^2$).

It is generally in the best interest of efficiency to run electroplating baths at as high a current density as possible, while maintaining the desired quality of the plating finish. The higher the current density, the faster the metal coating plates on the surface. The current is carried by the ions in these baths and each type of ion has its own specific conductance. In a plating bath, however, ionic conductance is only one variable that must be considered in choosing an electrolyte. The final criterion is the quality of the coating at the desired current density.

Halide Baths

Plating baths with the main electrolyte being a halide ion ($Br^-$, $Cl^-$, $F^-$, $I^-$) have been used for many decades. See for example, U.S. Pat. Nos. 4,013,523, 4,053,374; 4,270,990; 4,560,446 and 4,612,091. The main halide ions in these baths have been chloride and fluoride. The metals plated from these baths typically include tin, nickel, copper, zinc, cadmium and alloys of these metals. As with all other types of baths it has been found that improvements on the performance of the bath can be made by incorporating additives into the bath. For example, U.S. Pat. Nos. 5,628,893 and 5,538,617 describe additives which can be used in a halogen tin plating bath for the purpose of reducing sludge formation by stabilizing the tin against oxidation.

There are many other properties of a bath that can be improved by additives. All of these properties are basically concerned with either the efficiency of the bath itself the quality of the deposit or the reduction of environmental effects. For example the additives for the tin bath described in U.S. Pat. Nos. 5,628,893 and 5,538,617 improve the efficiency of the bath and by decreasing the amount of waste also reduce the environmental effects.

SUMMARY OF THE INVENTION

The present invention relates to the use of alkali metal, alkaline earth metal, ammonium and substituted ammonium salts of alkyl and alkanol sulfonic acid which have been found to improve the performance of halide electroplating baths. When used in these electroplating baths these salt additives were found to generally increase the plating range so that these baths can be used at much higher current densities than previously. Thus these baths can be run at greater speeds than those without these additives. Further improvements are seen in the quality of the deposits.

Thus, the present invention is directed to a method of improving the plating performance of an aqueous halide ion based electroplating bath comprising the step of adding an effective performance enhancing amount of a salt of an alkyl and/or alkanol sulfonic acid to said bath. In preferred embodiments, the halide ion of the bath is usually either chloride or fluoride.

The salts used to improve the bath plating performance characteristics are particularly selected from the group consisting of alkali metal, alkaline earth metal, ammonium and substituted ammonium salts. Especially preferred are salts of 2-hydroxy ethyl sulfonic acid, especially the sodium salt (sodium isethionate).

The baths that can be improved by the present invention include tin and tin alloy plating baths; nickel and nickel alloy plating baths; copper and copper alloy plating baths; zinc or zinc alloy plating baths; as well as cadmium and cadmium alloy plating baths.

DETAILED DESCRIPTION OF THE INVENTION

The use of alkali metal, alkaline earth metal, ammonium and substituted ammonium salts of alkyl and alkanol sulfonic acids as additives in pure metal and metal alloy halide electroplating baths has a number of unexpected benefits including wider useful current density range and improved appearance. The metals and metal alloys include, but are not limited to tin, lead, copper, nickel, zinc, cadmium, tin/zinc, zinc/nickel and tin/nickel.

These salts are not harmful to the environment, they are completely biodegradable and the products of the biodegradation are common ions and molecules found in the environment. In addition they have a number of other advantages including high solubility, low corrosivity to equipment, good stability at high temperatures, and compatibility with many other metal salts.

These baths also contain the corresponding metal salt or metal salts if an alloy plate is required, and various additives to control the quality and appearance of the plated surface and the stability of the bath solution. Typical additives include a surfactant such as an ethoxylated fatty alcohol, a brightening agent if required and an antioxidant such as hydroquinone or catechol, if tin is one of the metals being plated.

The tin in these baths is in the stannous or reduced form. If oxidation occurs the tin will be converted to the stannic or oxidized form which then commonly precipitates to form a sludge. This process adds to the inefficiency of these baths and also creates a requirement for constant filtering. Prior art patents, for example U.S. Pat. Nos. 4,717,460, 5,538,617 and 5,562,814 describe products that can decrease the amount of tin being oxidized.

The present invention will be further illustrated with reference to the following example which will aid in the understanding of the present invention, but which is not to be construed as a limitation thereof All percentages reported herein, unless otherwise specified, are percent by weight. All temperatures are expressed in decrees Celsius.

EXAMPLE #1

A halogen based plating bath was evaluated on the hydrodynamically controlled Hull Cell. Plating strips were made of steel and were pretreated by soaking for 15 seconds in an alkali, rinsing then immersing for 15 seconds in 10% sulfuric acid and rinsing again.

The following bath was evaluated to which various levels of sodium isethionate was added.

| Bath Composition (room temp.): | | | |
|---|---|---|---|
| 19.6 g/l $NaHF_2$<br>26.5 g/l NaF<br>12.68 g/l NaCl<br>33.0 g/l $SnF_2$<br>4 g/l Miranol ASC (an Amphoteric Surfactant) | | | |
| Run # | Current/Time | Additive | Results |
| 1 | 2 Amps/2 minutes | None | Dendrite growth 2 mm wide at high current density edge, remainder white matte/satin color |
| 2 | 3 Amps/2 minutes | None | Heavy burn at high current density edge 6 mm wide. Same color as Run No. 1. |
| 3 | 3 Amps/2 minutes | 4 g/l Sodium Isethionate | Burn not as pronounced and has narrowed to about 3 mm. Nice even smooth matte finish |
| 4 | 3 Amps/2 minutes | 6 g/l Sodium Isethionate | Burn diminished only to high current density edge. Same nice even smooth matte finish as Run No. 3. |

This experiment clearly shows that adding even small amounts of sodium isethionate to a halide bath can increase the workable current density range by a factor of 50%.

Theory Section

While not wishing to be bound by theory, the results of the present invention are believed to be based upon the following:

The mixture of different ionic species forms a unique combination that can produce metallic coatings with required properties. It is well known that the overall ionic conductivity of the solution depends on the character of individual ionic species and their concentrations. The specific interactions between different ionic species and/or solvent molecules determine the overall conductivity and may affect electrodeposition processes. However, ionic conductivity is only one variable, which must be considered in formulating plating baths.

It is also well known that the structure of the electrical double layer can affect the rates of electrodeposition. It was proven experimentally, see for example, Lasia et al., *Journal of Electroanalytical Chemistry,* 266, 68–81 (1989); Fawcett et al., *Journal of Electroanalytical Chemistry,* 279, 243–256 (1990); Lasia et al., *Journal of Electroanalytical Chemistry,* 288, 153–165 (1990) and Balch et al., *Journal of Electroanalytical Chemistry,* 427, 137–146 (1997), that the rate constant of electroreduction of certain metal ions (like $Cu^{+}$, $Cd^{2+}$ or $Zn^{2+}$) depends on the solvating ability of the solvent and the size of the cation of the electrolyte. The effect was attributed to the electrostatic interactions in the inner layer of the electrical double layer.

According to the Frumkin model, the rate constant for the reduction process:

$$Met^{n+}+ne-Met^{0}$$

is given by:

$$\ln k_f=\ln(k_0Y_M)+\alpha_a\, n\, F\phi^d/RT-\alpha_a nF(E-E_s)/RT$$

where the symbols are:

$k_f$ apparent rate constant $k_0$ potential independent portion of the rate constant $Y_M$ activity coefficient of the species $Met^{n+}$ in the bulk solution $\alpha_a$ apparent transfer coefficient for reduction n number of electrons involved in electroreduction F Faraday constant $\phi^d$ potential drop across the diffuse layer R gas constant T temperature in K E potential $E_s$ standard potential of the electroreduction reaction It is also known that the size of the counter ion of supporting electrolyte affects the $\phi^d$ potential, and as a consequence, the rate constant of overall electroreduction process (Lasia et al., Fawcett et al., and Lasia et al., supra).

It is clear that the addition of one or more salts as taught herein modifies the double layer of inetal/solution interface. The modification is caused by the alkali metal cation and/or alkanol-sulfonic acid anion and/or combination of both of them (maybe alkyl-, also). Therefore, the added salt of an alkyl and/or alkanol sulfonic acid should be considered as a plating additive, rather than as a simple modification of the supporting electrolyte. In the present invention, the cation and/or anion are not added only to preserve ionic conductivity of the electrolyte and/or solubility of deposited ion(s); instead they directly affect the electrodeposition process, by affecting the double layer structure and in consequence the mechanism of the electroreduction process.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of improving the plating performance of an aqueous halide ion electrolyte electroplating bath comprising the step of adding an effective amount of a salt of an alkyl and/or alkanol sulfonic acid to said bath to operate said bath at higher current densities, wherein the added salt is selected from the group consisting of alkali metal, alkaline earth metal, and ammonium or substituted ammonium salts.

2. The method of claim 1, wherein the halide ion is selected from chloride and fluoride ions.

3. The method of claim 1, wherein the salt is a salt of 2-hydroxy ethyl sulfonic acid.

4. The method of claim 3, wherein the salt is sodium isethionate.

5. The method of claim 1, 2, 3 or 4, wherein the electroplating bath is a tin or tin alloy electroplating bath.

6. The method of claim 1, 2, 3 or 4, wherein the electroplating bath is a nickel or nickel alloy electroplating bath.

7. The method of claim 1, 2, 3 or 4, wherein the electroplating bath is a copper or copper alloy electroplating bath.

8. The method of claim 1, 2, 3 or 4, wherein the electroplating bath is a zinc or zinc alloy electroplating bath.

9. The method of claim 1, 2, 3 or 4, wherein the electroplating bath is a cadmium or cadmium alloy electroplating bath.

10. An aqueous metal alloy halide electroplating bath comprising:

(a) a source of halide anions as principal electrolyte;

(b) one or more soluble platable metal salts, wherein the platable metal is selected from the group consisting of tin, nickel, copper, zinc, cadmium and mixtures thereof; and (c) a salt of an alkyl sulfonic acid and alkanol sulfonic acid in an effective amount to operate said bath at higher current densities, wherein the salt is selected from the group consisting of alkali metal, alkaline earth metal, and ammonium or substituted ammonium salts.

11. The electroplating bath of claim 10, wherein the sulfonic acid salt is a salt of 2-hydroxy ethyl sulfonic acid.

12. The electroplating bath of claim 11, wherein the salt is sodium isethionate.

* * * * *